United States Patent [19]

Inoue

[11] 4,429,943

[45] Feb. 7, 1984

[54] INSULATION BOX FOR WIRE HARNESS CONNECTOR DEVICE

[75] Inventor: Nori Inoue, Suzuka, Japan

[73] Assignee: Tokai Electric Wire Company Limited, Yokkaichi, Japan

[21] Appl. No.: 321,228

[22] Filed: Nov. 13, 1981

[30] Foreign Application Priority Data

| | | | |
|---|---|---|---|
| Nov. 14, 1980 | [JP] | Japan | 55-161266 |
| Dec. 5, 1980 | [JP] | Japan | 55-175365[U] |
| Feb. 10, 1981 | [JP] | Japan | 56-17430[U] |
| Feb. 25, 1981 | [JP] | Japan | 56-25633[U] |
| Apr. 4, 1981 | [JP] | Japan | 56-48996[U] |

[51] Int. Cl.[3] ..... H01R 9/00

[52] U.S. Cl. ..... 339/198 R; 339/22 B

[58] Field of Search ..... 339/20, 21 R, 22 B, 339/157 R, 159 R, 159 C, 198 R, 198 P

[56] References Cited

U.S. PATENT DOCUMENTS

| | | | |
|---|---|---|---|
| 2,707,774 | 5/1955 | Keller | 339/198 R |
| 2,720,632 | 10/1955 | Stieglitz | 339/22 B |
| 2,970,286 | 1/1961 | Modrey | 339/21 R |
| 3,189,866 | 6/1965 | Lazar et al. | 339/198 P |
| 3,213,403 | 10/1965 | Hermann et al. | 339/22 B |
| 3,263,131 | 7/1966 | Rowe | 339/22 B |
| 3,601,754 | 8/1971 | Filson | 339/22 B |
| 3,725,843 | 4/1973 | Johnson | 339/22 B |
| 3,869,185 | 3/1975 | Teagno | 339/65 |

FOREIGN PATENT DOCUMENTS

| | | | |
|---|---|---|---|
| 2227663 | 11/1974 | France | 339/22 B |
| 54-75062 | 6/1979 | Japan . | |
| 55-203880 | of 1980 | Japan . | |
| 55-4093680 | 9/1980 | Japan . | |

*Primary Examiner*—John McQuade
*Assistant Examiner*—Gary F. Paumen
*Attorney, Agent, or Firm*—Cushman, Darby & Cushman

[57] ABSTRACT

An insulation box of wire harness connecting device for interconnecting a plurality of wire harnesses of, for example, wirings around an automobile engine. The insertion box is formed by molding in one body to have a plurality of passages adapted for receiving conductive strips constituting electric paths which are arranged in a side-by-side relation to provide connection between wire harnesses or to branch the wire harnesses into a plurality of wire harnesses. The insulation box has at least one connector fitting hole formed, for example, in the upper wall thereof and at least one aperture formed, for example, in the lower wall thereof, such that the passages receiving the conductive strips are exposed to the outside of the insulation box through either the connector fitting hole or the aperture at any point along the length thereof. Thanks to this structural feature, the insulation box can be formed by molding by a split type mold consisting of an upper and lower mold halves separable in the vertical direction. The conductor strips are adapted to be inserted into the passages in the insulation box through respective conductor strip insertion holes formed in at least one longitudinal end walls of the insulation box.

7 Claims, 16 Drawing Figures

INSULATION BOX FOR WIRE HARNESS CONNECTOR DEVICE

FIELD OF THE INVENTION

The present invention relates to a harness connector device for interconnecting wire harnesses which are used for efficiently laying electric wirings having many branch lines in, for example, automobiles. More particularly, the invention is conerned with a novel construction of an insulation box for such a wire harness connector device.

BRIEF DESCRIPTION OF THE DRAWINGS

FIGS. 13 to 16 are illustrations of an example of connectors adapted to be used in combination with the insulation box embodying the present invention in which:

FIG. 13 is a cross-sectional view showing the insulation box having conductor strips and connectors incorporated therein;

FIG. 14 is a partly cut-away sectional view of the insulation box as shown in FIG. 13; and FIG. 15 is a front elevational view of an electric connector element incorporated in the connector; and FIG. 16 is a partly-sectioned side elevational view of the element shown in FIG. 16.

DESCRIPTION OF THE PRIOR ART

Figure 1:
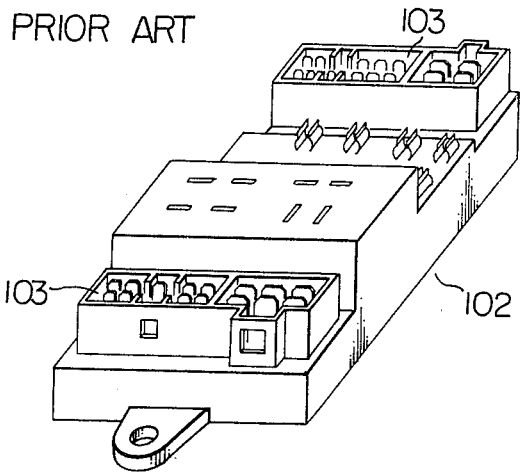
FIG. 1 PRIOR ART
FIG. 1 is a perspective view of an example of conventional insulation box incorporating conductor strips constituting electric paths.
Figure 2:
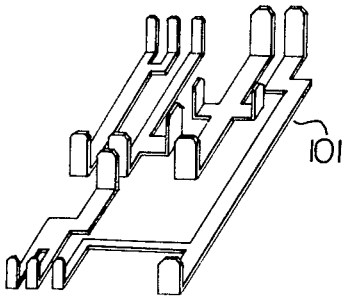
FIG. 2 PRIOR ART
FIG. 2 is a perspective view of the conductor strips incorporated in the insulation box shown in FIG. 1.

FIGS. 1 and 2 show a typical example of a wire harness connector device having an insulation box and conductor strips incorporated in the insulation box. More specifically, the wire harness connector device has an insulation box 102 encasing electric paths 101 (See FIG. 2) which are composed of conductive strips punched from a conductive metallic plate in accordance with the pattern of various branching circuits which exist in the electric wiring around the engine of an automobile. These conductor strips have bent ends which are concentrated in a plurality of connector fitting portions 103 provided on the insulation box 102. These connector fitting portions 103 are adapted to receive a plurality of connectors to which connected are wire harnesses from various electric equipments around the engine, the connectors being arranged suitably to concentrate the wire harnesses in accordance with the kinds of wire harnesses, direction of cords and so forth. In consequence, various wire harnesses are interconnected together or branched in a concentrated manner through the electric paths of the wire harness connectors.

The wire harness connector device of the kind described suffers the following disadvantages. Namely, assembly of the device becomes very troublesome when the circuit becomes complicated. More specifically, the electric paths are arranged in layers with an insulating plate interposed between adjacent layers of electric paths, and the bent ends of respective electric paths are made to pass through apertures formed in the insulation plates to appear at suitable portions in the connector fitting portions. Thus, the assembling of the wire harness connecting device requires quite a troublesome and time consuming works for disposing the electric pathes at predetermined positions, stacking the electric paths in layers with the insulating plates between adjacent layers of electric paths and placing the thus formed laminated structure in the insulation box.

SUMMARY OF THE INVENTION

Accordingly, an object of the invention is to provide an insulation box for wire harness connecting device, which is easy to produce and capable of facilitating the mounting of conductor strips therein.

To this end, according to the invention, there is provided an insulation box of wire harness connecting device for interconnecting wire harnesses, characterized by comprising: a plurality of passages adapted to receive a plurality of conductor strips in a spaced and side-by-side relation; at least one of a connector fitting hole formed in a first wall provided at one breadthwise end of the passages and providing a communication between the passages and the exterior of the passage, and a connector fitting hole formed in a second wall provided at the other breadthwise end of the passage and providing a communication between the passage and the exterior; an aperture formed in at least one of the first and second walls and communicating with the passages, the connector fitting hole and the aperture being so arranged in relation to each other that the passages are opened to the exterior thorugh at least one of the connector fitting hole and aperture at any point along the length of the passages; and a conductor strip insertion hole formed in at least one of a third and fourth walls provided at one and the other longitudinal ends of the passage and communicating with the passage.

The above and other objects, as well as advantageous features of the invention will become more clear from the following description of the preferred embodiment taken in conjunction with the atcompanying drawings, particularly FIGS. 3 through 16.

DESCRIPTION OF THE PREFERRED EMBODIMENTS

Figure 3:
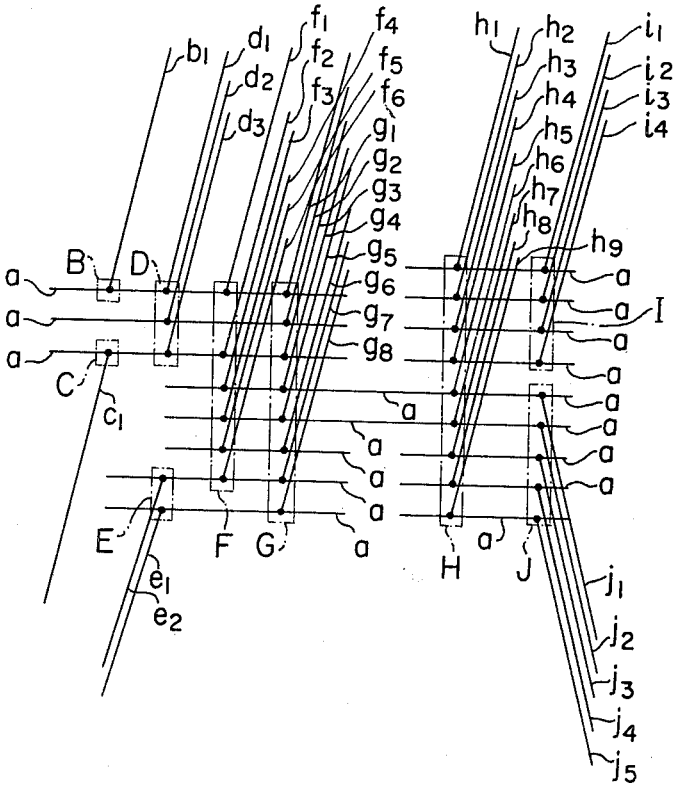
FIG. 3 illustrates an example of wire connecting form adopted in a wire harness connector device having an insulation box in accordance with the invention.

FIG. 3 shows an example of wire connecting forms adopted in a wire harness connecting device employing an insulation box of the invention. In this example, a plurality of conductor strip members (a) constituting straight electric paths are arranged in a side-by-side relation. A plurality of wire harnesses from various electric equipments or components are sorted into a plurality of groups in accordance with the kind or nature of the line, direction of the cords and other factors. These groups are, in the illustrated arrangement, represented by symbols $b_1$; $c_1$; $d_1$, $d_2$, $d_3$; $e_1$, $e_2$; . . . ; $j_1$, $j_2$, $j_3$, $j_4$, $j_5$. These groups of wire harnesses are connected to the conductor strips members (a) at points which are spaced in the longitudinal direction of the conductor strip members (a), i.e. at points (B), (C), (D), (E), . . . , (J). In consequence, the wire harnesses are interconnected to one another or branched from another harness through the electric paths. For instance, in the illustrated arrangement, the wire harnesses $b_1$, $d_1$, $f_1$, and $g_1$ are connected together. Similarly, wire harnesses $d_2$ and $g_2$ are connected to each other. On the other hand, the wire harness $c_1$ is branched into wire harnesses $d_3$, $f_3$, $g_3$.

Figure 4:
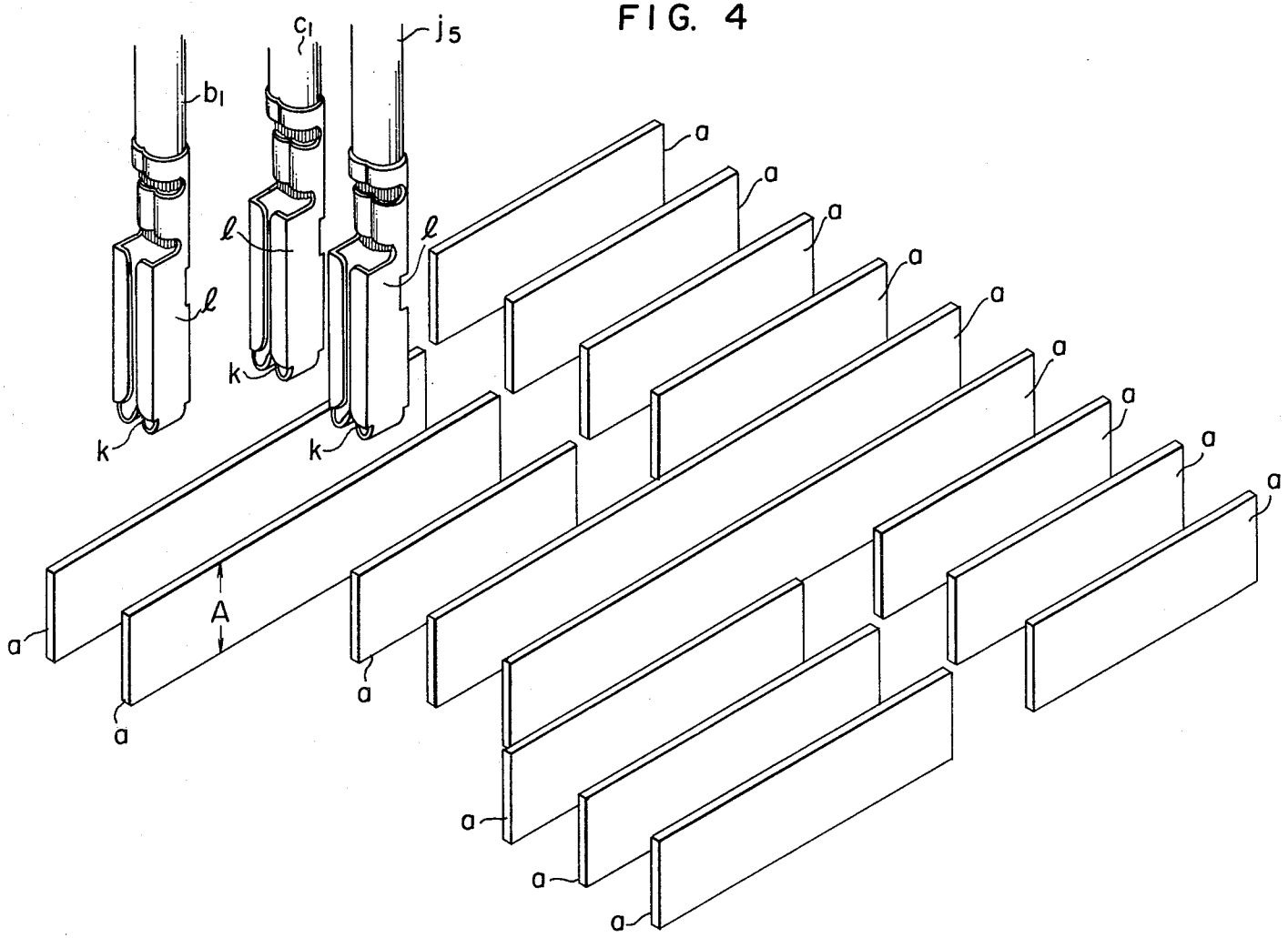
FIG. 4 is an illustration of a practical example of wire connecting form as shown in FIG. 3.
Figure 5:
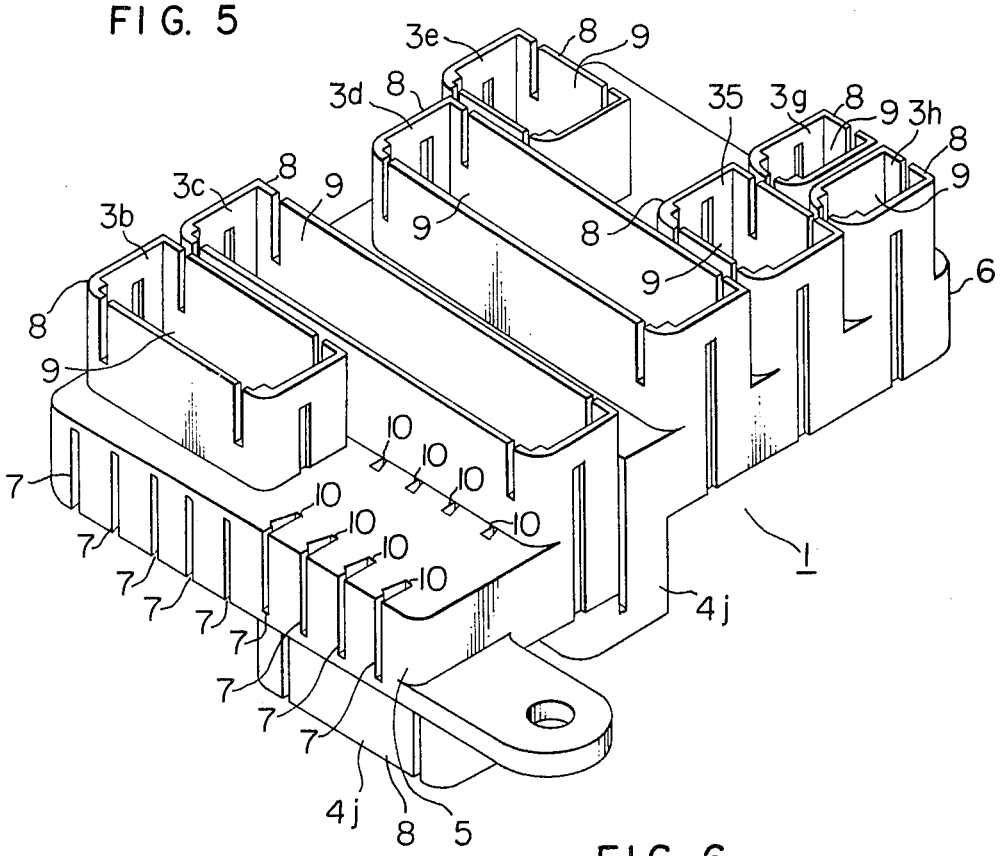
FIG. 5 is a perspective view of an insulation box constructed in accordance with an embodiment of the invention.
Figure 6:
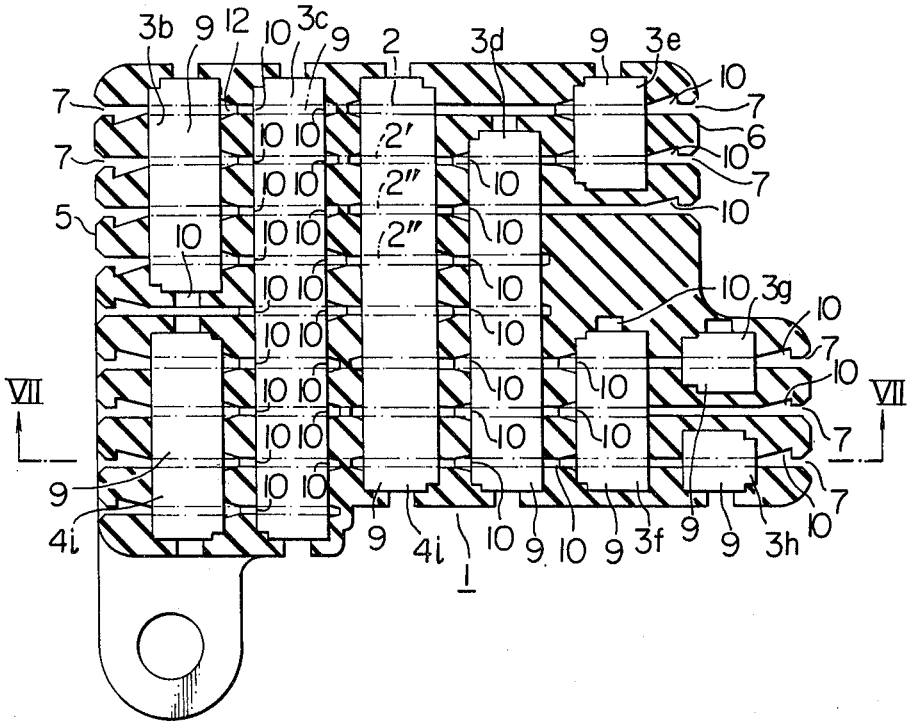
FIG. 6 is a horizontal sectional view of the insulation box as shown in FIG. 5.
Figure 7:
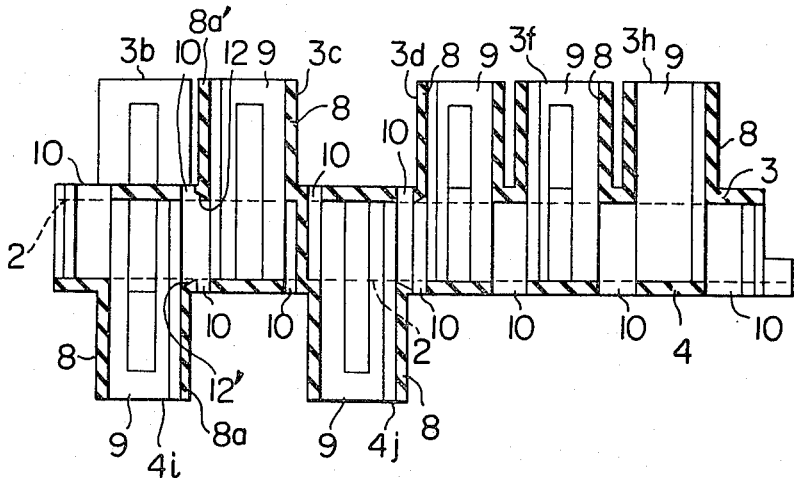
FIG. 7 is a sectional view taken along the line VII—VII of FIG. 6.

FIG. 4 shows the connecting form shown in FIG. 3 in a practical form. The conductive strip members (a) are arranged in a side-by-side relation with their flat major surfaces facing to those of adjacent ones. An electric connector (l) having a clip portion (k) is connected to the end of each wire harness. The connecting of the wire harness to the conductive strip member (a) is made by sliding the clipping portion (k) of the connector (l) in contact with the surface of the conductor strip (a) in the breadthwise direction (arrow A) of the latter to make the clipping portion (k) firmly clip the sheet-like conductor strip member (a).

Referring now to FIGS. 5, 6, 7 and 9, an insulation box 1 accomodating the straight conductive strip members (a) are provided therein with a plurality of passages 2, 2″ for receiving the conductive strip members (a) in a side-by-side relation with their major flat surfaces facing to those of adjacent ones, as explained in connection with FIG. 3, and also with connector fitting portions 3*b*, 3*c*, 3*d*, 3*e*, 3*f*, 3*g*, 3*h* and 4*i*, 4*j*, in its upper and lower walls 3, 4, respectively.

Each of the passages 2, 2′ . . . is opened to the exterior of the insulation box 1 through a conductive strip insertion hole 7 formed in at least one of the opposing walls 5, 6 formed to define the longitudinal ends of the passage.

Each of the connector fitting portions 3*b*, 3*c*, 3*d*, 3*e*; 3*f*, 3*g*, 3*h* and 4*i*, 4*j* is provided with a frame wall 8 protruded from upper and lower walls 3, 4 at suitable portions of the latter, and a connector fitting hole 9 surrounded by the frame wall 8. The connector fitting hole 9 on the upper wall 3 of the insulation box extends through the upper wall 3 to communicate the passages 2, 2′. Thus, the bottom of such a connector fitting hole 9 is constituted by the lower wall 4 of the insulation box. Similarly, the connector fitting hole 9 surrounded by the frame wall 8 protruded from the lower wall 4 of the insulation box extends through the lower wall 4 to communicate the internal passages 2, 2′ . . . and is terminated by the bottom which is constituted by the upper wall 3 of the insulation box.

It will be understood that the conductive strip members (a) received by the passages 2, 2′ are disposed such that the breadth A thereof extend in the opening direction of the connector fitting portions 3*b*, 3*c*, 3*d*, 3*e*; 3*f*, 3*g*, 3*h* and 4*i*, 4*j*, so that the clipping portions (k) of the electric connector elements (l) can clip the conductor strip members (a) as they are inserted into the passages 2, 2′ through respective connector fitting portions.

The passages 2, 2′ . . . are opened in at least one of the upper wall and lower walls 3, 4 over their entire lengths. To this end, apertures 10 are formed, besides the connector fitting holes 9, to provide communication between the passages 2, 2′ . . . and the exterior. The aperture 10 and the connector fitting hole 9 associated with a common passage 2 are formed to communicate with the latter from the upper and lower sides, alternatingly. The arrangement of the connector fitting hole 9 and the aperture 10 in connection with the passages 2, 2′ will be explained more fully with specific reference to FIG. 7. In the case where a plurality of connector fitting portions 3*d*, 3*f* are formed in the upper wall 3 at a suitable pitch, the apertures 10 are formed in the lower wall 4 at portions of the latter between the bottoms of the connector fitting holes 9. In the case where the connector fitting portions 3*c*, 4*i* neighbouring in the longitudinal direction of the passages 2, 2′ are formed in the upper and lower walls 3, 4 to open in opposite directions, two apertures 10 are formed in the lower and upper walls 4, 3: namely a first aperture 10 which is formed in the lower wall 4 at a portion thereof between the bottom of the connector fitting portion 3*c* and a side wall 8*a* of the frame wall 8 defining the connector fitting portion 4*i* and adjacent to the bottom of the connector fitting portion 3*c*, and a second aperture 10 formed in the upper wall 3 at a portion of the latter between the bottom of the connector fitting portion 4*i* and a side wall 8*a*′ of the frame wall 8 defining the connector fitting portion 3*c* and adjacent to the bottom of the connector fitting portion 4*i*, as will be seen from FIG. 7.

In the area between the insertion hole 7 for conductive strip member (a) and the connector fitting portion 4*i* adjacent to the insertion hole 7, an aperture 10 is formed in the wall 4 to extend from the insertion hole 7 to the bottom of the connector fitting portion 4*i*.

Figure 8:
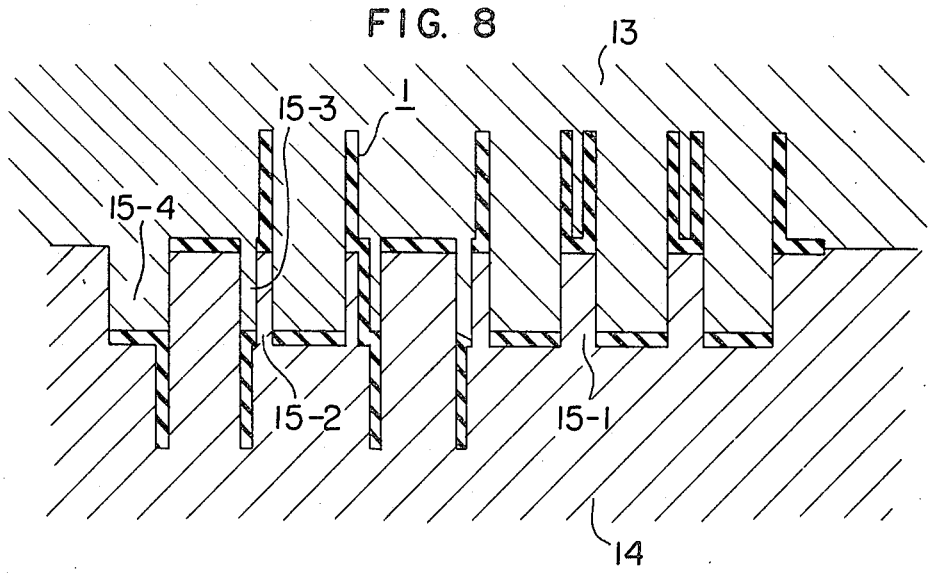
FIG. 8 is a sectional view of a mold for forming the insulation box as shown in FIG. 5.

Thus, there are four types of apertures 10. These apertures 10 are formed by projections 15-1, 15-2, 15-3 and 15-4 provided in a pair of mold parts 13, 14 for integrally forming the insulation box, as shown in FIG. 8. Portions of the inner surfaces of the passages 2, 2′ are determined by the end surfaces of these projections. The corners formed by the surfaces of the connector fitting holes 9 or apertures 10 and the surfaces of the passages 2, 2′, 2″ . . . , facing toward the strip conductor insertion hole 7, are rounded to present ramp portions 12, 12′ . . . which effectively function as guides for the conductive strip members (a) when the latter are inserted into passages 2, 2′, 2″ . . .

The conductive strip members (a) are arranged in the insulation box 1 in accordance with the wire connecting form as illustrated in FIG. 3. The connector fitting portions 3*b*, 3*c*, 3*d*, 3*e*; 4*i*, 4*j* are formed at the portions of the insulation box 1 correspodning to the points B, C, . . . J where the groups of the wire harnesses $b_1$, $c_1$ . . . , $j_1$, $j_2$, $j_3$, $j_4$, $j_5$ are connected to the conductive strip members (a). As stated before, the connection of the connecting end of each wire harness is made by means of an electric connector element (l) having a clipping portion (k) which is adapted to be slided in the breadthwise direction of the conductive strip member (a) to clip the latter. As will be seen from FIG. 9, the connector elements (l) are adapted to be guided into the associated connector fitting portions 3*b*, 3*c*, 3*d*, 3*e*; 3*f*, 3*g*, 3*h*; 4*i*, 4*j* by means of connectors 11 adapted to fit in these fitting portions.

In the illustrated embodiment of the invention, as will be understood from the foregoing description, the insulation box 1 has a plurality of passages 2, 2' . . . adapted to receive linear conductive strip members (a). Each passage is communicated with the exterior of the insulation box 1 through connector fitting holes 9 and apertures 10 which are formed in a staggered or alternating manner in the upper and lower walls 3, 4 opposing to each other across each passage 2, so that each passage is opened to the exterior over its entire length through at least one of the upper and lower walls 3, 4. In addition, an insertion hole 7 for inserting the conductive strip member (a) is formed in at least one of the walls at which the passage terminates.

The insulation box of this embodiment, therefore, can be formed in one body by molding using the upper and lower mold parts 13, 14. The laying of the conductive strip members (a) in the insulation box 1 can be made easily simply by inserting the conductive strip members (a) into the passages 2, 2' . . . through the insertion holes 7. Thus, the production and assembling of the wire harness connecting device are remarkably similified and facilitated.

Figure 10:
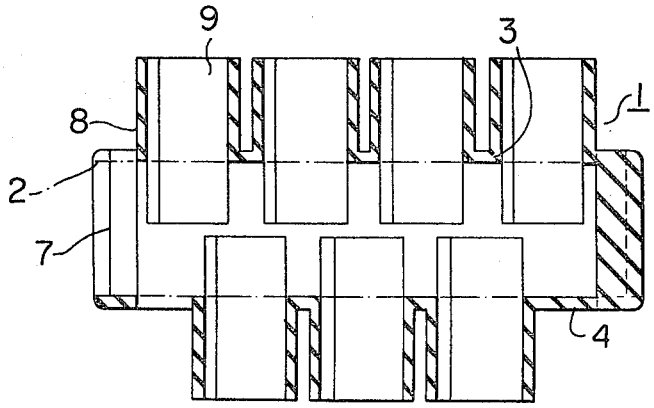
FIG. 10 is a sectional view of a modification of the insulation box as shown in FIG. 5.
Figure 9:
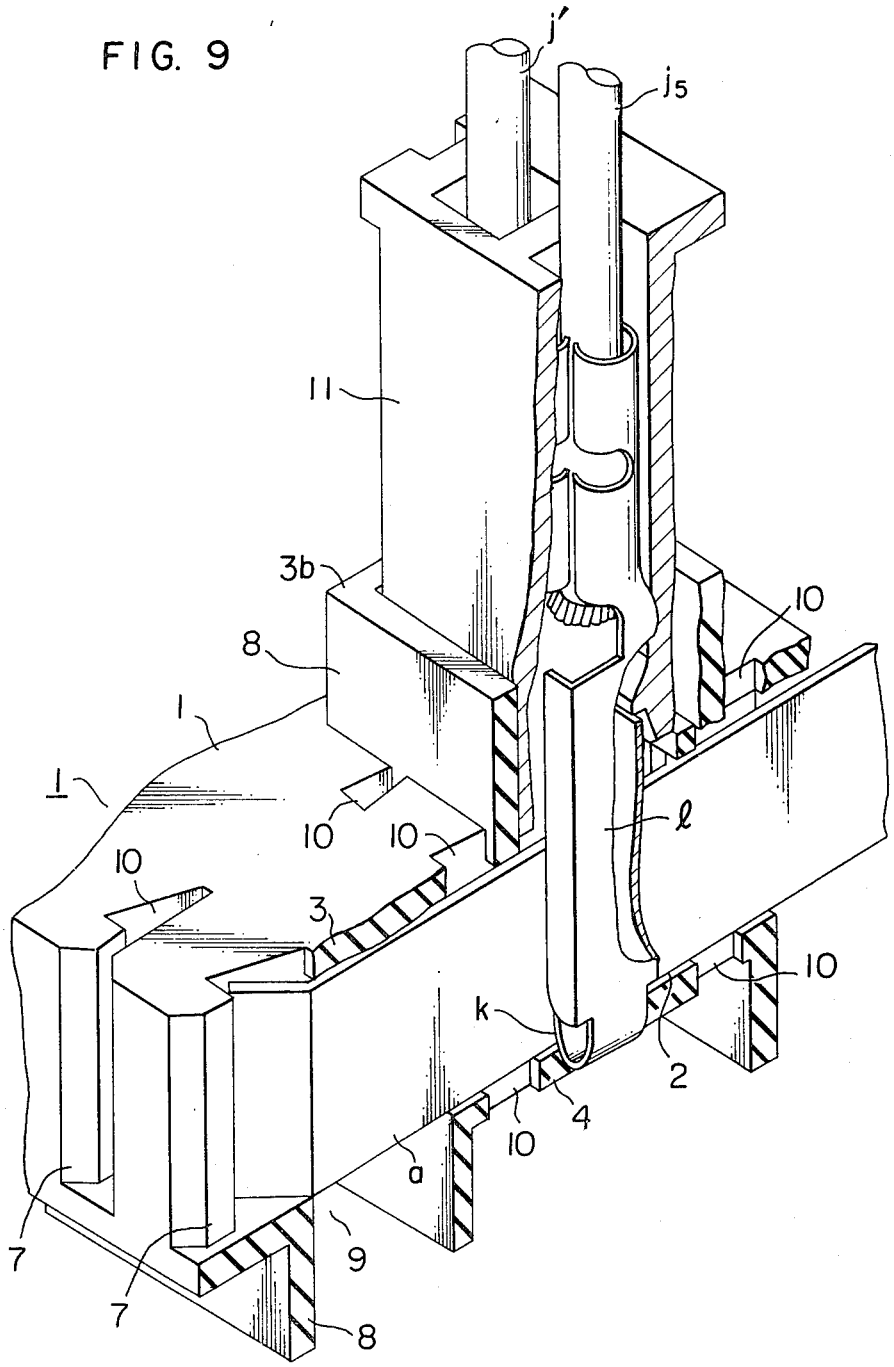
FIG. 9 is a partly cut-away perspective view of an insulation box as shown in FIG. 5, with conductor strips and connectors attached thereto.
Figure 11:
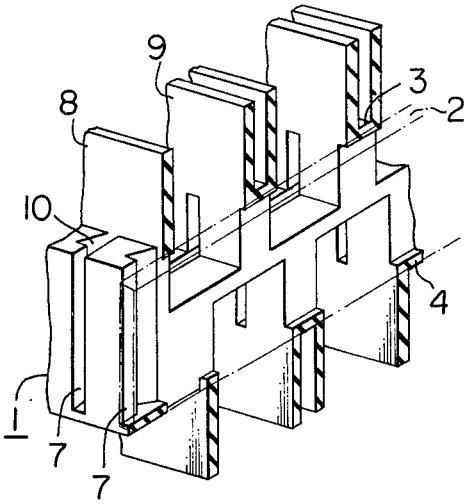
FIG. 11 is a partly cut-away perspective view of the modification as shown in FIG. 10.

FIGS. 10 and 11 show a modification of the embodiment described hereinbefore. In this modification, the connector fitting holes 9 of the connector fitting portions formed in the upper and lower walls of the insulation box are partially overlapped in the left and right direction as viewed in FIG. 10. In this modification, therefore, some longitudinal regions of each passage 2, 2' . . . are opened to the outside through the connector fitting holes 9 in the upper wall 3 and also through the fitting holes 9 formed in the lower wall 4 of the same.

Figure 12:
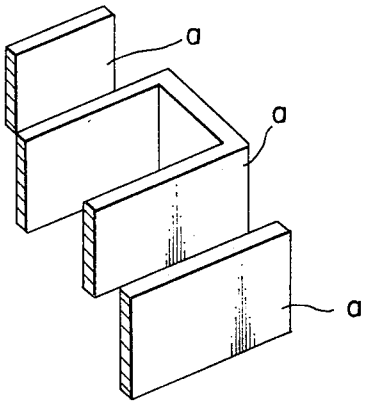
FIG. 12 is an illustration of conductor strips different from those shown in FIG. 4, usable in the insulation box as shown in FIG. 10.

According to the invention, it is possible to use conductive strip members (a) connected at their ends, as in the case of the member shown at the central part of FIG. 12.

As will be understood from the foregoing description, according to the invention, there is provided an insulation box accomodating a plurality of conductive strip members supported at their breadthside ends by the upper and lower walls of the insulation box, the conductor strip members being exposed to the outside through connector fitting holes and apertures formed in the upper and lower walls in an alternating manner. It is, therefore, possible to part the upper and lower mold parts in the breadthwise direction of the conductive strip members after the formation of the insulation box in one body. This insulation box having an integral construction can be produced easily and at a low cost, and can be used advantageously in place of conventional insulation boxes having, for example, a split type construction consisting of an upper and lower half parts separable from each other. Clearly, the insulation box of the invention having the described construction remarkably facilitates the mounting of the conductive strip members as compared with the conventional insulation boxes.

FIGS. 13 through 16 illustrate an example of connectors usable in combination with the insulation box of the described embodiment.

Figure 13:
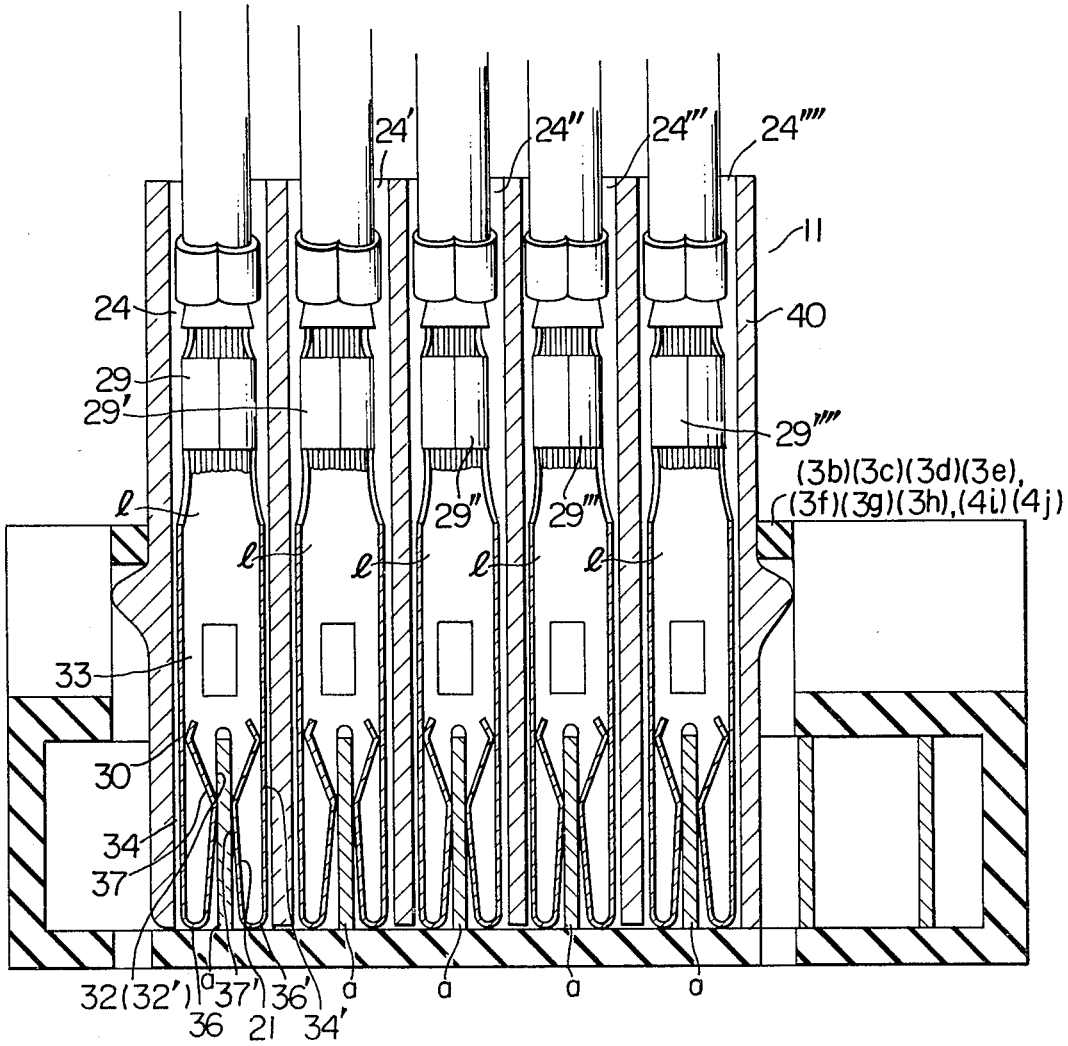
Figure 14:
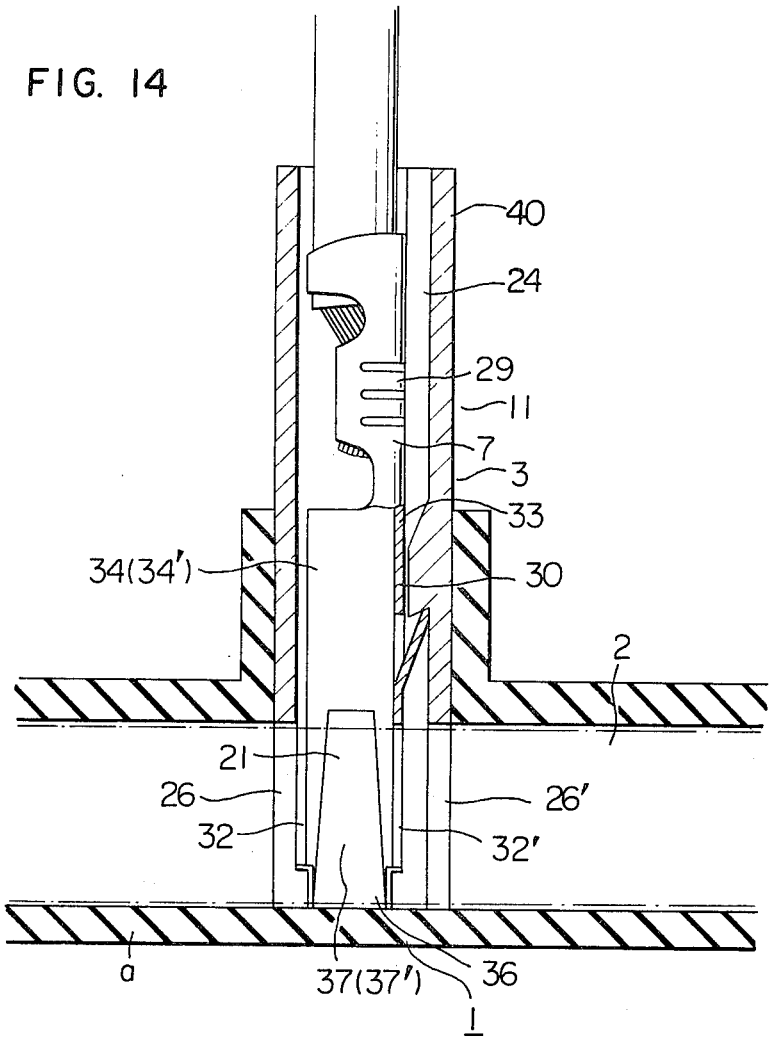

Referring first to FIGS. 13 and 14, the connector fitting portions *3b, 3c, 3d, 3e, 3f, 3g, 3h; 4i, 4j* are formed in the portions of the insulation box where the wire harnesses are to be connected to the conductive strip members (a), (a) . . . which are arranged in a side-by-side relation at a suitable gap between adjacent ones. The connector fitting portions have widths large enough to spread over the rows of conductor strip members and open in the breadthwise direction of the same. Thus, the conductive strip members (a), (a), . . . in rows in each connecting point are exposed to the outside of the insulation box through the connector fitting hole.

A connector 11 having cavities 24, 24' . . . corresponding to the conductive strip members (a), (a) . . . is fitted to each connector fitting portion *3b, 3c, 3d, 3e; 3f, 3g, 3h; 4i, 4j*. Each connector 11 has a connector housing 40 having walls defining the cavities 24, 24' . . . . These walls are extended downwardly to intersect the conductive strip members (a), (a) . . . Slots 26, 26' are formed in the lower extensions of the walls adapted to guide and receive the conductive strip members (a), (a) . . . into the cavity 24, 24' in the breadthwise direction of the conductive strip members (a), (a).

Each cavity 24 of the connector 11 has a connector element (l) for engagement with the conductive strip member received by the cavity 24.

Figure 15:
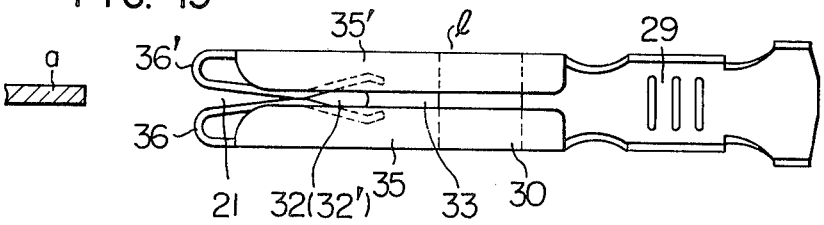
Figure 16:
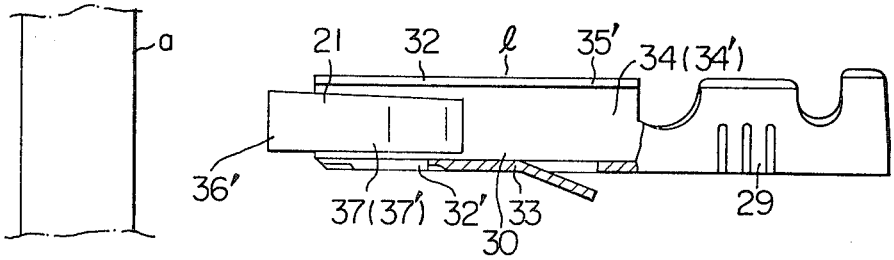

As will be seen from FIGS. 14 and 15, the connector elements (l), (l) have electric connecting portions 29 for connection to wire harnesses leading from various electric equipments or components, box-like receptacles 30 jointed to the electric connecting portions 29, electric contact portions 21 formed in the receptacles 30, and slots 32, 32' formed in the side walls of the receptacles 30 so as to correspond to the slots 26, 26' in the connector housing. The conductive strip members (a), (a) are electrically connected to the electric contact portions 21, as the conductive strip members (a), (a) are guided into the receptacles 30 through the slots 26, 26' and 32, 32'.

Each receptacle 30 includes a base plate 33, side walls 34, 34' protruding from both ends of the base plate 33 and top walls 35, 35' extending from upper ends of the side walls 34, 34' to oppose to each other. The electric contact portion 21 is constituted by contact tabs 37, 37' bent inwardly from the ends of the side walls 34, 34' of the receptacle 30. The slots 32, 32' are formed between the opposing upper walls 35, 35' and in the base plate 35.

Therefore, the conductive strip member (a), is introduced into the cavities 24, 24' along the slots 26, 26' formed in the connector housing 40 and guided into the receptacle 30 by the slots 32, 32' formed in the latter, so as to be resiliently clipped between contact tabs 37, 37' having resiliency.

It is conceivable that the conductive strip members (a), (a), when brought into contact with the contact tabs 37, 37', make contact with the tabs at inadequate or wrong angle to cause a plastic deformation at the base ends of the contact tabs 37, 37'. This problem, however, is perfectly obviated and a smooth and stable connection can be achieved thanks to the slots 32, 32' which correctly guides the conductive strip members (a), (a), As has been described, each connector fitting portion of the insulation box of the invention receives a connector 11 having cavities 24, 24' corresponding to the conductive strip members (a), (a). The lower end portions of the walls of the connector intersecting the conductive strip members (a) are provided with slots 26, 26' for guiding the conductive strip members in the breadthwise direction of the latter when the same are introduced into contact with the electric connector elements (l), (l) are accomodated by the cavities. It is, therefore, possible to obtain the conductive strip members simply by cutting a conductive metallic tape, although in some cases a bending of the cut tape is necessary. In addition, it is possible to connect the electric connector elements (l), (l) of the wire harness ends to the conductive strip members (a), (a) without any intermediate relaying terminals therebetween. In consequence, the assembling of the harness connecting device including the insulation box is very much simplified and facilitated.

Furthermore, since the connectors 11, 11 are allowed to come deeper into the insulation box 1, it is possible to reduce the size of the wire harness connecting device as a whole and to ensure the stable and firsm connection between the insulation box and the connectors 11 thereby to assure a high reliability of connection between wire harnesses.

According to the invention, each electric connector element (l) is composed of the electric connecting portion 29 connected to the end of the associated wire harness, the box-like receptacle 30 jointed to the connecting portion 29 and having slots 32, 32', and an electric contact portion 21 formed in the receptacle 30. The electric contact portion 21 is brought into contact with the conductive strip member (a) as the electric connector element is moved such that the conductive strip member (a) is moved into the receptacle while being guided by the slots 32, 32'. Therefore, the electric contact portion 21 is protected against any damaging force, by the box-like receptacle 30, so that it is never damaged by any external force in the states before and after fitting in the connector housing.

The electric contact portion 21 is smoothly and safely brought into contact with the conductive strip member (a) because the latter is correctly guided to the right position for contact with the electric contact portion 21.

Although the invention has been described through specific terms, it is to be noted here that the described embodiments are not exclusive and various changes and modifications may be imparted thereto without departing from the spirit and scope of the invention wich are limited solely by the appended claims.

What is claimed is:

1. An insulation box for connecting wire harnesses to a plurality of conductive strip members, comprising:

front and rear walls having a plurality of conductive strip insertion slots each communicating with one of a plurality of substantially parallel passages defined in said insulation box for holding the plurality of conductive strip members in a spaced, side-by-side, substantially parallel relationship;

a top wall connected to top ends of said front and rear walls and extending in a plane substantially parallel to the plane of said substantially parallel passages;

a bottom wall connected to bottom ends of said front and rear walls and extending in a plane substantially parallel to the plane of said substantially parallel passages;

at least one of said top and bottom walls having connector fitting openings formed therethrough for connecting the wire harnesses to said conductive strip members; and apertures formed in at least one of said top and bottom walls and communicating with said passages;

said connector fitting openings and said apertures being so arranged in relation to each other that the passages are opened to the exterior of the insulation box through at least one of said connector fitting openings and said apertures at any point along the length of said passages.

2. The insulation box of claim 1 further including right and left side walls connected to the front, rear, top and bottom walls parallel with the plurality of passages.

3. The insulation box of claim 1 further including frames protruding from and encircling the connector fitting openings.

4. The insulation box of claim 3 wherein the frames have a plurality of conductive strip insertion slots for enabling the plurality of conductive strip members to be inserted through said slots into said parallel passages.

5. The insulation box of claim 1 wherein the top and bottom walls having juxtaposed connector fitting openings therethrough.

6. The insulation box of claim 1 wherein the top and bottom walls spaced apart connector fitting openings therethrough.

7. An insulation box for connecting wire harnesses to a plurality of conductive strip members, comprising:

front and rear walls having a plurality of conductive strip insertion slots each communicated with one of a plurality of substantially parallel passages defined in said insulation box for holding the plurality of conductive strip members in a spaced, side-by-side, substantially parallel relationship;

a top wall connected to top ends of said front and rear walls and extending in a plane substantially parallel to the plane of said substantially parallel passages;

bottom wall connected to bottom ends of said front and rear walls and extending in a plane substantially parallel to the plane of said substantially parallel passages;

first connector fitting openings formed through said top wall for connecting the wire harnesses to said conductive strip members; and second connector fitting openings formed through said bottom wall for connecting the wire harnesses to said conductive strip members;

said first connector fitting openings and said second connector fitting openings being so arranged in relation to each other that the passages are opened to the exterior of the insulation box through at least one of said first and second connector fitting openings at any point along the length of said passages.

* * * * *